US005161442A

United States Patent [19]

Rilitz et al.

[11] Patent Number: 5,161,442

[45] Date of Patent: Nov. 10, 1992

[54] APPARATUS FOR CROSS CUTTING RUNNING WEBS

[75] Inventors: Norbert Rilitz; Wolfgang Faust; Arthur Van Wijk, all of Hamburg, Fed. Rep. of Germany

[73] Assignee: E. C. H. Will GmbH, Hamburg, Fed. Rep. of Germany

[21] Appl. No.: 808,189

[22] Filed: Dec. 13, 1991

[30] Foreign Application Priority Data

Feb. 27, 1991 [DE] Fed. Rep. of Germany ..... 4106084

[51] Int. Cl.[5] ..... B26D 1/62

[52] U.S. Cl. ..... 83/117; 83/345; 83/449; 83/493

[58] Field of Search ..... 83/345, 310, 373, 449, 83/493, 674, 677, 322, 323, 113, 115, 116, 117, 118, 119, 120, 121, 122

[56] References Cited

U.S. PATENT DOCUMENTS

| | | | |
|---|---|---|---|
| 1,015,836 | 1/1912 | Read | 83/116 X |
| 1,273,368 | 7/1918 | Hilton | 83/115 |
| 1,751,562 | 3/1930 | Stinger | 83/115 |
| 2,037,469 | 4/1936 | Harless | 83/117 X |
| 2,338,132 | 1/1944 | Sandberg | 83/118 X |
| 2,736,380 | 2/1956 | Dillenburger | 83/118 X |
| 3,205,744 | 9/1965 | Huck | 83/345 |
| 3,807,262 | 4/1974 | Vits | 83/117 |
| 3,828,636 | 8/1974 | Smith | 83/345 X |
| 4,004,479 | 1/1977 | Bodnar | 83/345 |
| 4,189,965 | 2/1980 | Kollann | 83/345 X |
| 4,201,102 | 5/1980 | Rudszinat | 83/298 |
| 4,255,998 | 3/1981 | Rudszinat | 83/298 |
| 4,347,959 | 9/1982 | Ivinger | 83/345 X |
| 4,392,402 | 7/1983 | Rann | 83/345 |
| 4,399,727 | 8/1983 | Omori et al. | 83/345 |

FOREIGN PATENT DOCUMENTS 2261729 7/1974 Fed. Rep. of Germany .

*Primary Examiner*—Douglas D. Watts
*Assistant Examiner*—Raymond D. Woods
*Attorney, Agent, or Firm*—Peter K. Kontler

[57] ABSTRACT

A cross cutter for a running web of paper which is transported along a horizontal path has an upper rotary knife holder above and a lower rotary knife holder below the horizontal path. The holders carry knives which extend transversely of the path, and each holder further carries an elastic lip-shaped deflector which is located behind the respective knife and serves to maintain the leader of the web behind the separated length of the web in or close to the path so that the leader can enter a transporting unit which advances the severed lengths of the web to a stacking or other processing station. The lower deflector is installed immediately behind and the upper deflector is spaced apart from the rear side of the respective knife.

7 Claims, 1 Drawing Sheet

APPARATUS FOR CROSS CUTTING RUNNING WEBS

BACKGROUND OF THE INVENTION

The invention relates to severing or cutting apparatus in general, and more particularly to improvements in apparatus for severing paper and/or other relatively thin flexible sheet materials. Still more particularly, the invention relates to improvements in so-called cross cutters which can be utilized to subdivide running webs or strips of flexible material into panels, sheets or lengths of desired size and shape.

Apparatus of the type to which the present invention pertains are disclosed, for example, in U.S. Pat. No. 4,201,102 granted May 6, 1980 to Rudszinat and in U.S. Pat. No. 4,255,998 granted Mar. 17, 1991 to Rudszinat.

As a rule, a cross cutter employs two rotary drum-shaped knife holders which are disposed at opposite sides of the path for a running web of paper, metallic foil, plastic foil or other relatively thin flexible sheet material. The holders are driven in synchronism so that their knives meet at a selected portion of the path for the web and sever the web transversely of the direction of advancement of the web toward a station where the separated panels, sheets or lengths are accepted by a transporting, stacking or other processing unit. Problems arise when the freshly formed leader of a relatively thin and readily flexible web exhibits a tendency to adhere to the one or the other knife holder immediately behind the locus of the cut, i.e., immediately behind the freshly formed sheet, panel or length. Such tendency of the freshly formed leader at the front end of the remainder of the running web can result in advancement of the leader in a wrong direction, i.e., the leader is likely to miss the receiving or intake or inlet end of the mechanism which is to engage and transport successive freshly separated sheets, panels or lengths of flexible material. In many or most instances, the leader behind a freshly separated sheet of paper or like flexible web or strip stock tends to adhere to the lower knife holder or tends to curl so that it is likely to miss the inlet of the transporting unit downstream of the severing station. This can result in lengthy interruptions of operation of one machine or of an entire battery of machines, e.g., if the cross cutter is used in a production line which is designed to turn out steno pads, exercise pads, stacks of wrapped, boxed and crated paper sheets and the like.

German patent application No. 22 61 729 of Ay Kut (published Jul. 4, 1974) discloses a cross cutter which is equipped with hold down devices in the form of air discharging nozzles or in the form of webs or ribs which are provided on the knife holders and serve to curl and thereby stiffen the leader of a running web behind the freshly separated sheet to thus reduce the tendency of the leader to stray by moving in a wrong direction and to thus bypass the sheet transporting unit. A drawback of this proposal is that the reliability of the hold down devices is overly dependent upon the characteristics (such as flexibility) of the running web. Additional problems arise if the hold down devices are utilized in machines which simultaneously process two or more running webs of paper or a like relatively thin and flexible material. Thus, it is necessary to individually adjust each and every one of two or more cross cutters and their hold down devices with attendant losses in time and long interruptions for each change of setup.

OBJECTS OF THE INVENTION

An object of the invention is to provide a cross cutting apparatus for running webs of paper or the like wherein the leaders of a web behind the freshly severed sheets, panels or lengths are less likely to stray from their prescribed paths than in heretofore known apparatus.

Another object of the invention is to provide a cross cutting apparatus wherein the leader of the running web is confined to advancement along a prescribed path in a novel and improved way.

A further object of the invention is to provide a method of modifying an existing cross cutter for paper or the like to reduce the likelihood of advancement of the leader of the running web in a wrong direction.

An additional object of the invention is to provide novel and improved conveyors for the knives of a cross cutter.

Still another object of the invention is to provide a cross cutter which can be utilized in existing production lines as a superior substitute for heretofore known and used cross cutters.

A further object of the invention is to provide novel and improved web guides for use in a cross cutter for running webs or strips of paper and the like.

Another object of the invention is to provide a novel and improved method of preventing curling, sticking and/or other undesirable tendencies of the leaders of running webs of paper or the like at the severing station of a cross cutter.

An additional object of the invention is to provide a cross cutter which renders it possible to sever a running web at a high frequency without risking stray movements of the leader behind a freshly separated sheet, panel or length of flexible material.

A further object of the invention is to provide a machine which embodies a cross cutting apparatus of the above outlined character.

SUMMARY OF THE INVENTION

The invention is embodied in an apparatus for repeatedly severing a web of relatively thin flexible material which is advanced in a predetermined direction along a predetermined path. The improved apparatus comprises first and second knives disposed at opposite sides of and extending substantially transversely of the predetermined path and being respectively movable in first and second directions along first and second endless paths having portions adjacent a portion of the predetermined path where the web is severed by the knives to separate a length of flexible material and to provide the web with a leader behind the separated length, first and second conveyors which have means for moving the first and second knives along the respective first and second endless paths, and first and second guides which are provided on the respective conveyors upstream of or behind the respective knives (as seen in the first and second directions) to maintain the leader of the web at least close to the predetermined path.

Each conveyor can constitute a rotary (e.g., drum-shaped) conveyor, and at least one of the guides can comprise an elongated deflector which extends substantially transversely of the predetermined path.

One of the endless paths can be disposed above the other endless path. For example, if the predetermined path for the web is a substantially horizontal path, the first conveyor and its knife can be located at a level below and the second conveyor and its knife can be located at a level above the horizontal path.

At least one of the guides can comprise or consist of rubber or another suitable elastomeric material. Such at least one guide can comprise or constitute an elastic lip which extends substantially transversely of the predetermined path.

At least one of the guides can be curved counter to the direction of movement of the respective knife along its endless path. Furthermore, at least one of the two guides can be at least substantially parallel to the rear side of the respective knife.

If the path for the web is a substantially horizontal path so that one of the conveyors (e.g., the first conveyor) is located at a level below such path, the first guide is preferably closely or immediately adjacent the rear side of the first knife. On the other hand, the second guide can be spaced apart from the rear side of the second knife if the second knife is located at a level above the path for the web.

If the first conveyor is a rotary conveyor so that the cutting edge of the first knife is caused to orbit along a circular path, the first guide preferably extends from the first conveyor substantially to the circular path of such cutting edge. On the other hand, and if the second conveyor is also a rotary conveyor so that the cutting edge of the second knife also orbits along a cicular path, the second guide preferably extends from the second conveyor toward but preferably at least slightly short of the circular path which is described by the cutting edge of the second knife at a level above the path for the web.

At least one of the conveyors can comprise a holder (e.g., a substantially drum-shaped or rotor-shaped body) and a device for clamping the respective knife to the holder. The guides can be provided on the respective clamping devices, and each such clamping device can comprise a wedge.

One of the conveyors can comprise means for moving the respective knife at a first speed, and the other conveyor can comprise means for advancing the respective knife at a different second speed. The arrangement can be such that the speed of the upper knife exceeds the speed of the lower knife.

The novel features which are considered as characteristic of the invention are set forth in particular in the appended claims. The improved cross cutting apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a schematic partly elevational and partly vertical sectional view of an apparatus which embodies one form of the present invention and defines a substantially horizontal path for a running web of paper or the like.

DESCRIPTION OF PREFERRED EMBODIMENTS

Figure 1:
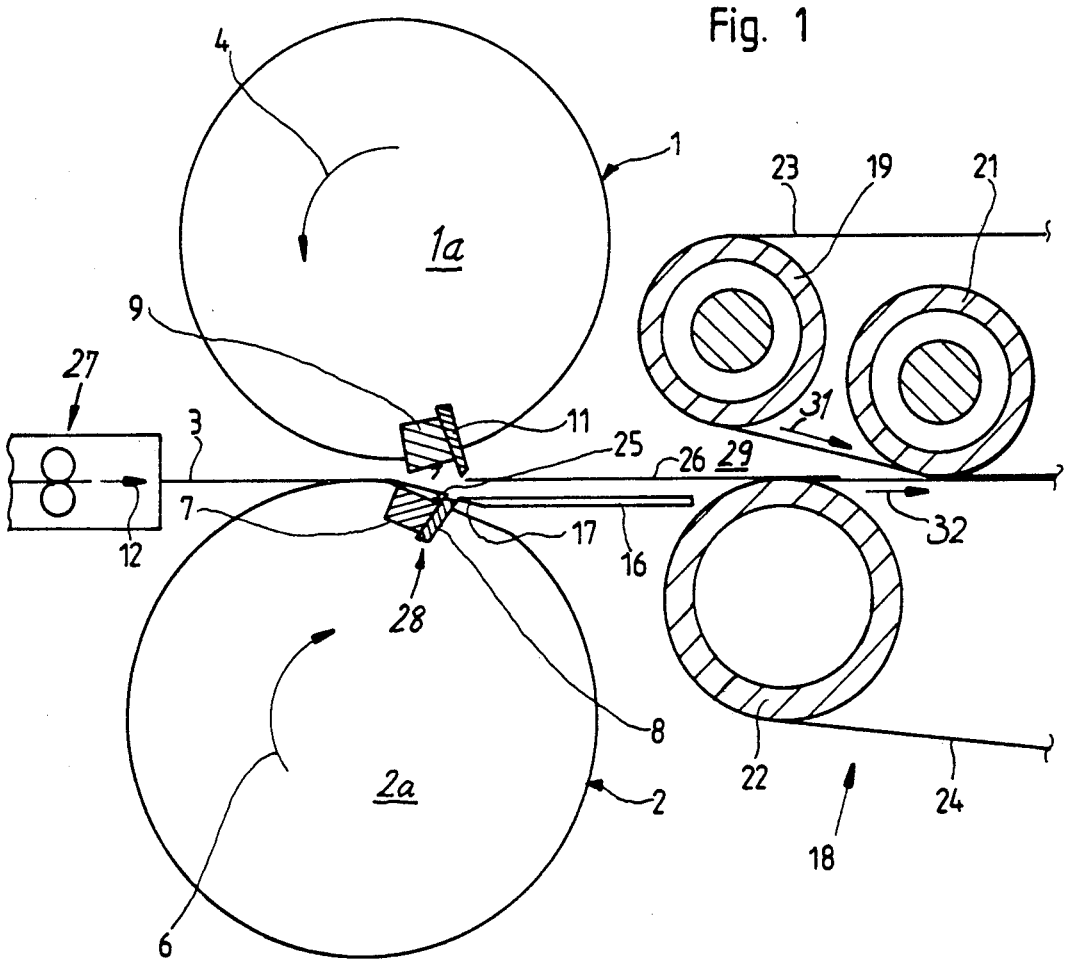

The cross cutting apparatus which is shown in FIG. 1 comprises a unit 27 which serves to advance a web 3 of paper or other relatively thin flexible material along a substantially horizontal path in the direction of arrow 12. Such path extends between an upper conveyor 1 which is rotatable about a horizontal axis to move an upper knife 11 along an endless path in the direction of arrow 4, and a lower conveyor 2 which is rotatable about a horizontal axis to move a lower knife 8 along an endless path in the direction of arrow 6. The knives 8, 11 meet once during each revolution of the respective conveyors 2, 1 to sever the running web 3 at a severing station 28 and to thus separate a sheet, panel or length 26 with simultaneous formation of a leader 25 immediately behind the trailing end of the freshly separated length 26. Each of the two conveyors 1, 2 comprises a rotary drum-shaped carrier or holder 1*a*, 2*a* and a wedge-like clamping device 9, 7 which engages and maintains the respective knife 11, 8 in a predetermined position relative to the holder. The cutting edges 11*a*, 8*a* of these knives are caused to orbit along circular paths when the respective holders 1*a*, 2*a* are driven to rotate in directions which are indicated by the arrows 4 and 6, respectively.

The diameter of the holder 1*a* is smaller than the diameter of the holder 2*a* and the conveyor 1 is operated to drive the holder 1*a* at a peripheral speed which is higher than the peripheral speed of the holder 2*a* for the knife 8.

Figure 2:
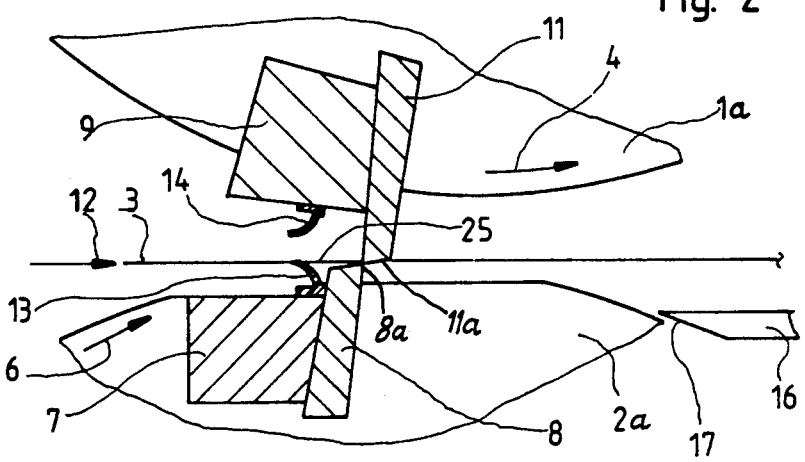
FIG. 2 is a greatly enlarged view of a detail in the apparatus of FIG. 1, showing the knives and the associated guides during advancement through the severing or cross cutting station.

In accordance with a feature of the invention, the wedge-like clamping device 7 for the lower knife 8 carries a first guide 13 which can be made of rubber or another suitable elastomeric material and is immediately or very closely adjacent the rear or upstream side of the knife 8 (as seen in the direction of arrow 6). The illustrated guide 13 is an elongated lip-shaped deflector which extends transversely of the path for the web 3 and is parallel to the rear or upstream side of the knife 8. FIG. 2 shows that the guide or deflector 13 is curved counter to the direction of arrow 6 (i.e., counter to the direction of movement of the knife 8 along its endless path, and that the radially outermost portion of the deflector 13 extends at least close to the circular path for the cutting edge 8*a* of the knife 8. In other words, the radially outermost portion of the guide 13 can steer the adjacent portion of the web 3 toward the locus where the cutting edges 8*a*, 11*a* of the knives 8, 11 cooperate once during each revolution of the conveyors 2, 1 to sever the web 3 and to separate a length 26 of flexible material from the thus obtained leader 25 at the front end of the remaining portion of the web.

The wedge-like clamping device 9 for the upper knife 11 carries a second guide 14 which is or can be a mirror image of the lower guide 13 except that it is spaced apart from the rear or upstream side of the knife 11 and does not extend all the way to the circular path for the cutting edge 11*a* of the knife 11. The material of the guide 14 may but need not be the same as the material of the lower guide 13.

The cross cutter of FIG. 1 further comprises a guide in the form of a bridge 16 which is located immediately downstream of the severing station 28. The sharp trailing (left-hand) end 17 of the bridge 16 constitutes a scraper which engages the peripheral surface of the lower holder 2*a* save at the knife 8 where the peripheral surface of the holder 2*a* includes a flat portion. The purpose of the bridge 16 is to reliably separate the freshly formed lengths 26 of flexible material from the conveyor 2 as well as to direct the leaders 25 into the inlet 29 of a transporting unit 18 serving to advance successive lengths 26 to the next processing station, e.g., into a stacker for discrete sheets or into an apparatus which assembles sheets into exercise pads or other stationery products. The illustrated transporting unit 18 comprises pulleys or sheaves 19, 21, 22 for endless conveyor belts 23 and 24. The neighboring reaches of the belts 23, 24 are caused to advance in directions which are respectively indicated by arrows 31 and 32.

The mode of operation is as follows:

The unit 27 draws the web 3 off a reel or another suitable source, not specifically shown, and advances the web in the direction of arrow 12, i.e., along a substantially horizontal path. The unit 27 can comprise one or more pairs of standard advancing rolls which are driven to advance the web 3 at a desired speed. The running web 3 is severed at selected intervals by the cutting edges 8*a*, 11*a* of the knives 8, 11 so that its front portion is subdivided into a series of discrete sheets, lengths or panels 26 each having a desired length. Successive lengths 26 enter the inlet 29 and are entrained by the belts 23, 24 toward a stacking or other processing station, not shown.

The radially outermost portion of the rearwardly curved lip-shaped elastic guide 13 engages the freshly formed leader 25 immediately behind the locus of severing the web 3 (see FIG. 2) and thus maintains the leader 25 away from the peripheral surface of the lower holder 2*a*. The purpose of the upper guide 14 is to return the leader 25 into the prescribed path (toward and into the inlet 29) if the deflecting action of the lower guide 13 is excessive and/or if the leader 25 tends to curl upwardly and/or if the leader 25 is attracted toward the peripheral surface of the upper holder 1*a* by suction due to higher rotational speed of the holder 1*a* of the conveyor 1.

An additional function of the lower guide 13 is to prevent the leader 25 from entering the narrow clearance between the peripheral surface of the lower holder 2*a* and the scraper-like sharp trailing end 17 of the bridge 16 immediately downstream of the severing station 28. This ensures that the leader 25 can advance along the bridge 16 and enters the inlet 29 to be engaged and entrained by the belts 23 and 24.

It has been found that the guides 13, 14 cooperate to stabilize the leader 25 so that the latter invariably advances along the prescribed path and enters the inlet 29 to be engaged by the belts 23, 24.

Each of the holders 1*a*, 2*a* can be provided with a plurality of preferably equidistant knives. It is equally within the purview of the invention to replace the holders 1*a*, 2*a* with chains or other suitable conveying means each of which can carry one or more knives. Furthermore, the web 3 can be caused to advance along a vertical path or along a path which is inclined to the horizontal and to the vertical. Still further, the one and/or the other guide need not be elastic, and each of these guides can consist of a row of aligned relatively short guides. Elastic guides (particularly an elastic guide beneath a web which is advanced along a substantially horizontal path) are preferred at this time because they can yieldably intercept the leader 25 and gently return it into the prescribed path. This is particularly important if the web consists of a highly sensitive material which is likely to be scratched and/or otherwise adversely affected as a result of contact with one or more relatively hard guides. At the same time, elastic guides are fully capable of preventing the leader of the running web from adhering to the respective knife holders and/or other parts of the conveyors for the respective knives.

Though it is possible to install the lower guide 13 at a certain distance from the rear or upstream side of the knife 8, the mounting which is shown in FIG. 2 is preferred in many instances because the guide 13 is even more likely to perform the aforediscussed additional function, namely that of preventing the leader 25 from penetrating into the clearance between the peripheral surface of the holder 2*a* and the sharp trailing end 17 of the bridge 16 downstream of the severing station 28.

The feature that the radially outermost portion of the lower guide 13 extends at least very close to the circular path for the cutting edge 8*a* of the knife 8 is desirable and advantageous because this entails a certain tensioning of the web 3 during severing by the cutting edges 8*a*, 11*a* of the knives 8 and 11. Such tensioning contributes to the making of clean cuts. The afore-discussed mounting of the upper guide 14 at a certain distance from the rear side of the respective knife 11 is particularly desirable when the peripheral speed of the holder 1*a* exceeds the peripheral speed of the holder 2*a*. The radially outermost portion of the guide 14 then intercepts the leader 25 if the latter is propelled upwardly by the lower guide 13. The freshly formed leader 25 exhibits a certain tendency to move upwardly toward the peripheral surface of the holder 1*a* due to the aforediscussed tensioning action of the lower guide 13, i.e., due to the fact that the radially outermost portion of the guide 13 preferably extends at least close to or all the way to the circular path for the cutting edge 8*a* of the lower knife 8.

An advantage of the feature that the guides 13, 14 are mounted on the respective clamping devices 7, 9 is that such mounting can be completed in the plant subsequent to making of the clamping members. The guides 13, 14 can be glued or otherwise reliably secured to the respective clamping devices 7, 9 or to the respective holders 2*a*, 1*a*. In fact, at least the lower guide 13 can be secured directly to the rear side of the knife 8.

An advantage which is common to all embodiments of the improved cross cutting apparatus is that the leader 25 of a running web 3 of relatively thin and readily flexible paper or like material is highly unlikely to adhere to the conveyors for the knives and is much more likely to be directed in substantially stretched condition into the transporting unit 18 downstream of the severing station 28.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for repeatedly severing a web of relatively thin flexible material which is advanced in a predetermined direction along an at least substantially horizontal path, comprising first and second knives disposed at opposite sides of and extending substantially transversely of said at least substantially horizontal path and being respectively movable in first and second directions along first and second endless paths having portions adjacent a portion of said at least substantially horizontal path where the web is severed by said knives to separate a length of flexible material and to provide the web with a leader behind the separated length, said second endless path being disposed above said first endless path and each of said knives having a front side and a rear side, facing downstream and upstream, respectively, with respect to said at least substantially horizontal path; first and second rotary conveyors having means for moving said first and second knives along the respective endless paths; and first and second guides fixed on the respective conveyors upstream of the respective knives, with respect to said at least substantially horizontal path, to maintain the leader at least close to said at least substantially horizontal path, said second guide being spaced apart from the rear side of said second knife, at least one of said guides comprising an elongated deflector extending substantially transversely of said at least substantially horizontal path and at least one of said guides comprising an elastomeric material and having an elastic lip with extends substantially transversely of said at least substantially horizontal path, at least said first guide extending substantially transversely of said predetermined direction and being curved counter to the direction of movement of said first knife along said first endless path, said first guide being at least closely adjacent the rear side of said first knife.

2. The apparatus of claim 1, wherein at least said first guide is substantially parallel to the rear side of said first knife.

3. The apparatus of claim 1, wherein said first endless path is a circular path and said first knife has a cutting edge which advances along a circular path in response to movement of the first knife along said first endless path, said first guide extending from said first conveyor at least substantially to said circular path.

4. The apparatus of claim 1, wherein said second knife has a cutting edge which advances along a circular path in response to movement of the second knife along said second endless path, said second guide extending from said second conveyor toward but short of said circular path.

5. The apparatus of claim 1, wherein at least said first conveyor comprises a holder and a device for clamping said first knife to said holder, said first guide being provided on said clamping device.

6. The apparatus of claim 5, wherein said holder includes a rotor and said clamping device comprises a wedge mounted in said rotor.

7. The apparatus of claim 1, wherein one of said conveyors includes means for moving the respective knife and the respective guide at a first speed, the other of said conveyors comprising means for moving the respective knife and the respective guide at a different second speed.

* * * * *